US010690419B2

(12) United States Patent
Koga et al.

(10) Patent No.: US 10,690,419 B2
(45) Date of Patent: Jun. 23, 2020

(54) HEAT EXCHANGER

(71) Applicant: Toyota Jidosha Kabushiki Kaisha, Toyota-shi, Aichi-ken (JP)

(72) Inventors: Yoshihiro Koga, Gifu (JP); Toshio Murata, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 67 days.

(21) Appl. No.: 16/160,367

(22) Filed: Oct. 15, 2018

(65) Prior Publication Data

US 2019/0113283 A1 Apr. 18, 2019

(30) Foreign Application Priority Data

Oct. 17, 2017 (JP) ..... 2017-201111

(51) Int. Cl.
*F28D 7/00* (2006.01)
*F28F 7/02* (2006.01)
*F28F 21/04* (2006.01)

(52) U.S. Cl.
CPC ..... *F28D 7/0033* (2013.01); *F28F 7/02* (2013.01); *F28F 21/04* (2013.01); *F28F 2220/00* (2013.01); *F28F 2250/102* (2013.01)

(58) Field of Classification Search
CPC .. F28D 7/0033; F28D 7/00; F28F 7/02; F28F 21/04; F28F 2220/00; F28F 2250/102
USPC ..... 165/165
See application file for complete search history.

(56) References Cited

U.S. PATENT DOCUMENTS 3,903,694 A * 9/1975 Aine ..... B01D 53/22 60/274
4,546,827 A * 10/1985 Wachendorfer, Sr. .... F28F 7/02 165/146
5,416,057 A * 5/1995 Lipp ..... F01N 3/2828 165/133
2010/0132928 A1* 6/2010 Sutherland ..... B01J 19/2485 165/159

FOREIGN PATENT DOCUMENTS

| | | | |
|---|---|---|---|
| CN | 102227255 | A | 10/2011 |
| JP | 2003-240454 | A | 8/2003 |
| JP | 2013-178018 | A | 9/2013 |
| JP | 2015-140273 | A | 8/2015 |
| JP | 2015-140972 | A | 8/2015 |
| JP | 2016-097392 | A | 5/2016 |
| WO | 2013/082066 | A1 | 6/2013 |
| WO | 2015/115255 | A1 | 8/2015 |

* cited by examiner

*Primary Examiner* — Joel M Attey
(74) *Attorney, Agent, or Firm* — Dinsmore & Shohl

(57) ABSTRACT

A heat exchanger includes a peripheral wall having a polygonal tube shape and partition walls that divide an inside of the peripheral wall into first cells and second cells, the first cells and the second cells extending in an axial direction of the peripheral wall. Ends of each of the first cells in the axial direction are sealed and adjacent ones of the first cells are in communication with one another so that the first cells constitute a first passage having a U-shaped cross section perpendicular to the axial direction. The first passage includes an inflow port and an outflow port that are open in the same surface of the peripheral wall. Each of the second cells constitutes a second passage including an inflow port and an outflow port provided respectively at ends of each of the second cells in the axial direction.

9 Claims, 8 Drawing Sheets

PRIOR ART

HEAT EXCHANGER

CROSS-REFERENCE TO RELATED APPLICATIONS

This application claims priority to Japanese Patent Application No. 2017-201111 filed Oct. 17, 2017, which is incorporated herein by reference in its entirety including the specification, drawings, and abstract.

BACKGROUND

1. Field

The present disclosure relates to a heat exchanger.

2. Description of Related Art

Japanese Laid-Open Patent Publication No. 2015-140972 discloses a heat exchanger 40. As shown in FIGS. 16A, 16B, and 16C, the heat exchanger 40 includes a peripheral wall 41, which has a rectangular cross section and extends in an axial direction, and partition walls 42, which divide the inside of the peripheral wall 41 into first cells 43*a* and second cells 43*b* extending in the axial direction. The opposite ends of each first cell 43*a* in the axial direction are sealed, and first cells 43*a* vertically adjacent to each other are in communication. The first cells 43*a* constitute a first passage 44 having an inflow port 44*a* and an outflow port 44*b*, which are open in the peripheral wall 41. Each second cell 43*b* constitutes a second passage 45 including an inflow port and an outflow port respectively provided at the opposite ends of the second cell 43*b* in the axial direction. The heat exchanger exchanges heat between a first fluid flowing through the first passage 44 and a second fluid flowing through the second passage 45.

As shown in FIG. 163, the inflow port 44*a* of the first passage 44 opens in the upper surface of the peripheral wall 41, and the outflow port 44*b* of the first passage 44 opens in the lower surface of the peripheral wall 41. In this case, passage members such as pipes configured to supply and discharge the first fluid are respectively attached to the upper surface and the lower surface of the heat exchanger. Thus, when the heat exchanger is installed, the passage members attached to the upper surface and the lower surface need to be taken into account in order to ensure a sufficiently large installment space. However, the heat exchanger is often installed in a limited space such as the inside of a vehicle. Accordingly, the required installment space for the heat exchanger is desirably small.

SUMMARY

This Summary is provided to introduce a selection of concepts in a simplified form that are further described below in the Detailed Description. This Summary is not intended to be used as an aid in determining the scope of the claimed subject matter.

It is an object to provide a heat exchanger of which the required installment space is small.

A heat exchanger according to the embodiments that solves the above problem includes a peripheral wall having a polygonal tube shape and partition walls that divide an inside of the peripheral wall into first cells and second cells, the first cells and the second cells extending in an axial direction of the peripheral wall. Ends of each of the first cells in the axial direction are sealed and adjacent ones of the first cells are in communication with one another so that the first cells constitute a first passage having a U-shaped cross section perpendicular to the axial direction. The first passage includes an inflow port and an outflow port that are open in the same surface of the peripheral wall. Each of the second cells constitutes a second passage including an inflow port and an outflow port provided respectively at ends of each of the second cells in the axial direction. Heat is exchanged between a first fluid flowing through the first passage and a second fluid flowing through the second passages.

Other features, aspects, and advantages will become apparent from the following description, taken in conjunction with the accompanying drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
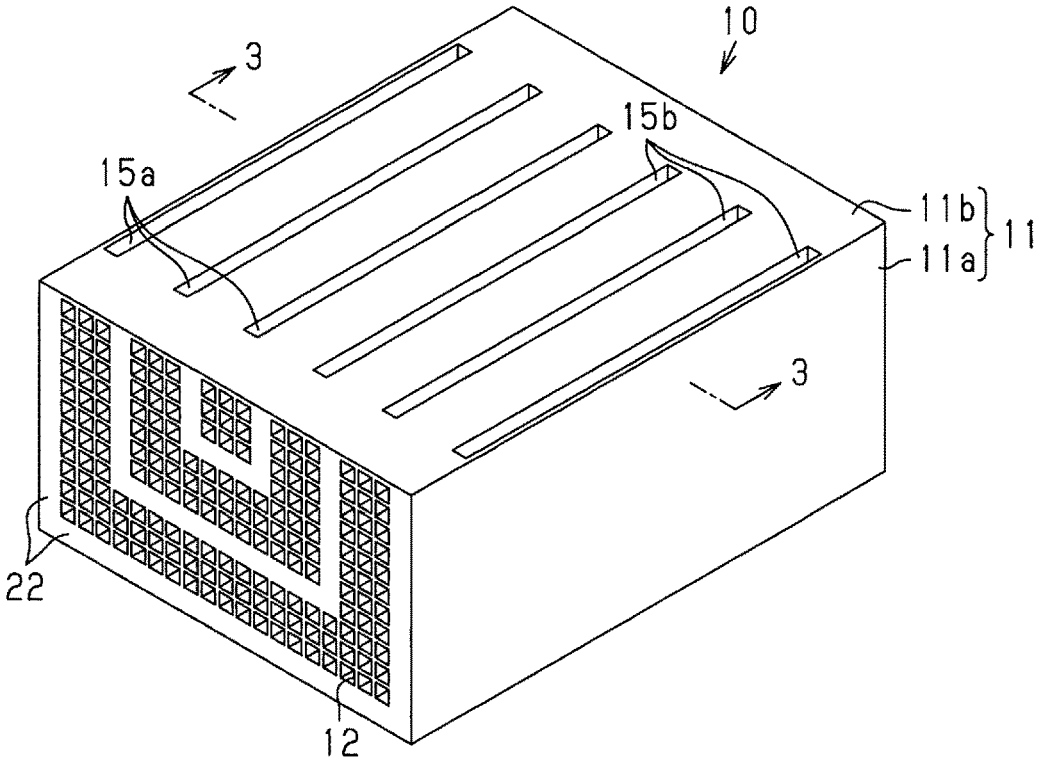
FIG. 1 is a perspective view showing a heat exchanger according to one embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Unless indicated otherwise, a statement that a first layer is "on" or "connected to" a second layer or a substrate is to be interpreted as covering both a case where the first layer directly contacts the second layer or the substrate, and a case where one or more other layers are disposed between the first layer and the second layer or the substrate.

Words describing relative spatial relationships, such as "below", "beneath", "under", "lower", "bottom", "above", "over", "upper", "top", "left", and "right", may be used to conveniently describe spatial relationships of one device or elements with other devices or elements. Such words are to be interpreted as encompassing a device oriented as illustrated in the drawings, and in other orientations in use or operation. For example, an example in which a device includes a second layer disposed above a first layer based on the orientation of the device illustrated in the drawings also encompasses the device when the device is flipped upside down in use or operation.

A heat exchanger 10 according to an embodiment will now be described.

Figure 2:
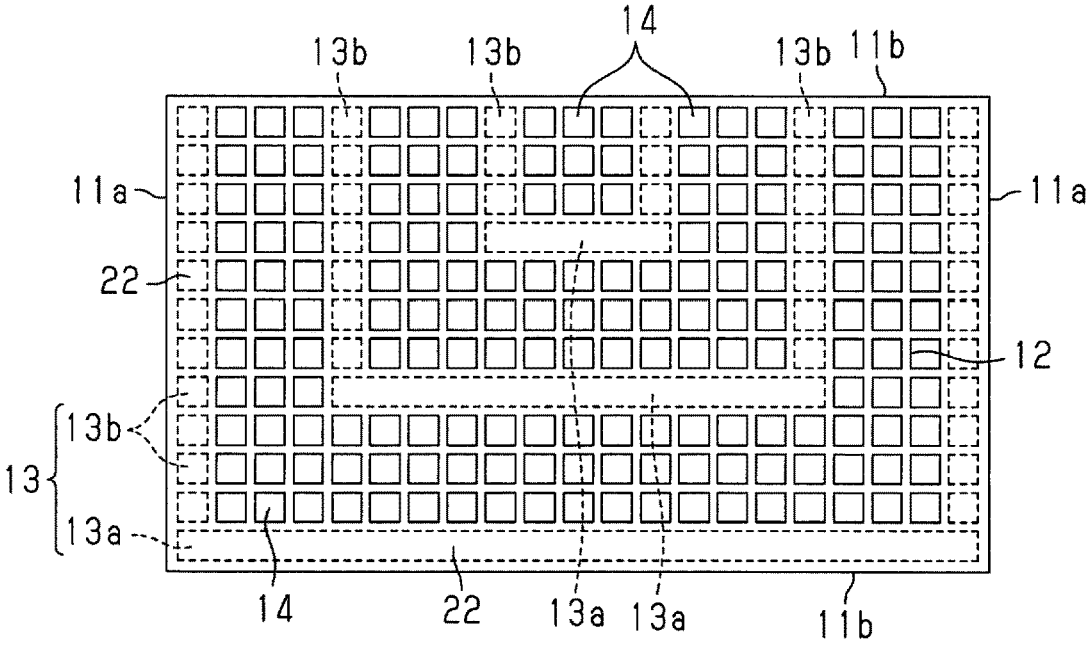
FIG. 2 is a front view of the heat exchanger of FIG. 1.

As shown in FIGS. 1 and 2, the heat exchanger 10 includes a peripheral wall 11, which has a rectangular tube shape, and partition walls 12. The peripheral wall 11 includes three or more flat outer surfaces to constitute a polygonal cross section and extends in an axial direction. The axial direction is a direction in which the peripheral wall 11 extends and is a direction parallel to all the outer surfaces of the peripheral wall 11. The partition walls 12 divide the inside of the peripheral wall 11 into first cells 13 and second cells 14, which extend in the axial direction of the peripheral wall 11. The peripheral wall 11 includes, for example, two opposed vertical walls 11*a* and two opposed horizontal walls 11*b*. In the cross-sectional view perpendicular to the axial direction of the peripheral wall 11, the vertical walls 11*a* are shorter than the horizontal walls 11*b*. In the present embodiment, in the cross-sectional view perpendicular to the axial direction of the peripheral wall 11, the extending direction of the vertical walls 11*a* is referred to as the vertical direction, and the extending direction of the horizontal walls 11*b* is referred to as the lateral direction. The shape of the cross section perpendicular to the axial direction of the peripheral wall 11 is a horizontally-long rectangle. Unless otherwise indicated, the "cross section" hereinafter refers to the cross section perpendicular to the axial direction of the peripheral wall 11.

Figure 3:
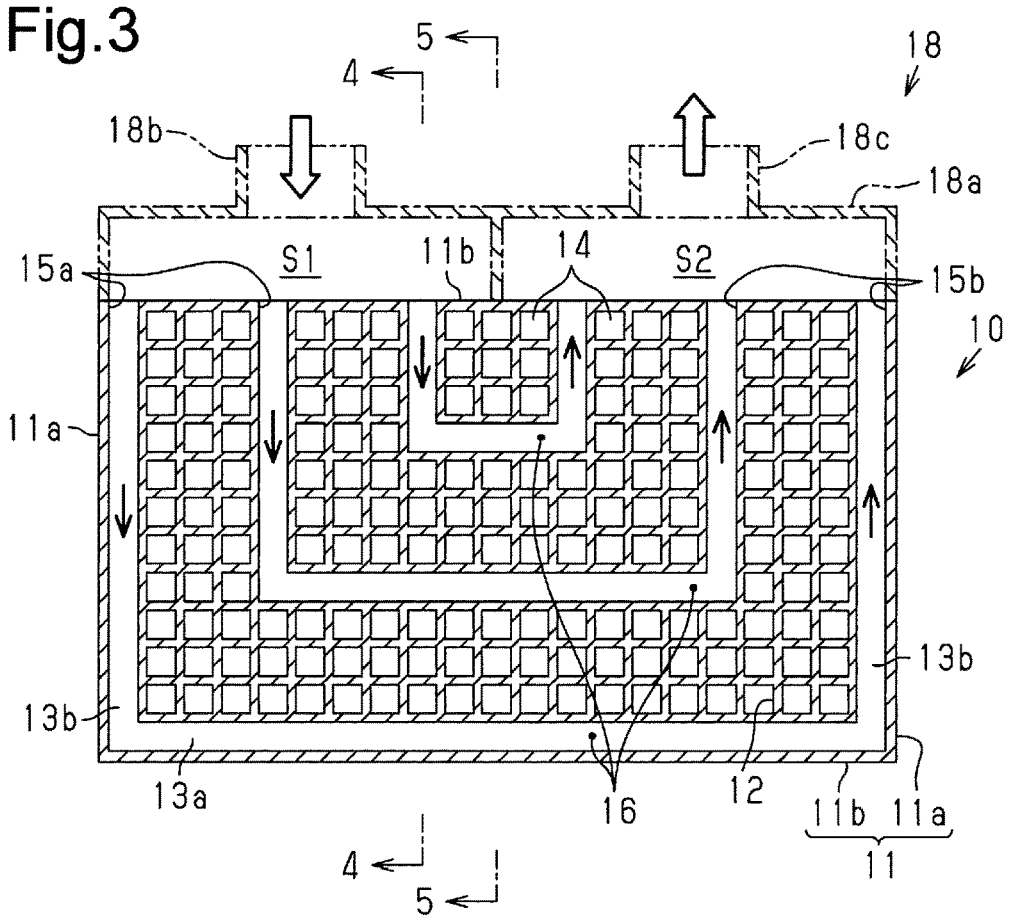
FIG. 3 is a cross-sectional view taken along line 3-3 in FIG. 1.

As shown in FIGS. 2 and 3, in the cross section perpendicular to the axial direction of the peripheral wall 11, the partition walls 12 include partition walls 12 parallel to the vertical walls 11*a* and partition walls 12 parallel to the vertical walls 11*b*. The partition walls 12 are integrated to constitute a cell structure having a grid pattern. The cell structure of the integrated partition walls 12 is not particularly limited but may be, for example, a cell structure in which the thickness of each partition wall 12 is 0.1 to 0.5 mm and the cell density is 15 to 93 cells per 1 $cm^2$ of the cross section perpendicular to the axial direction of the peripheral wall 11.

Figure 4:
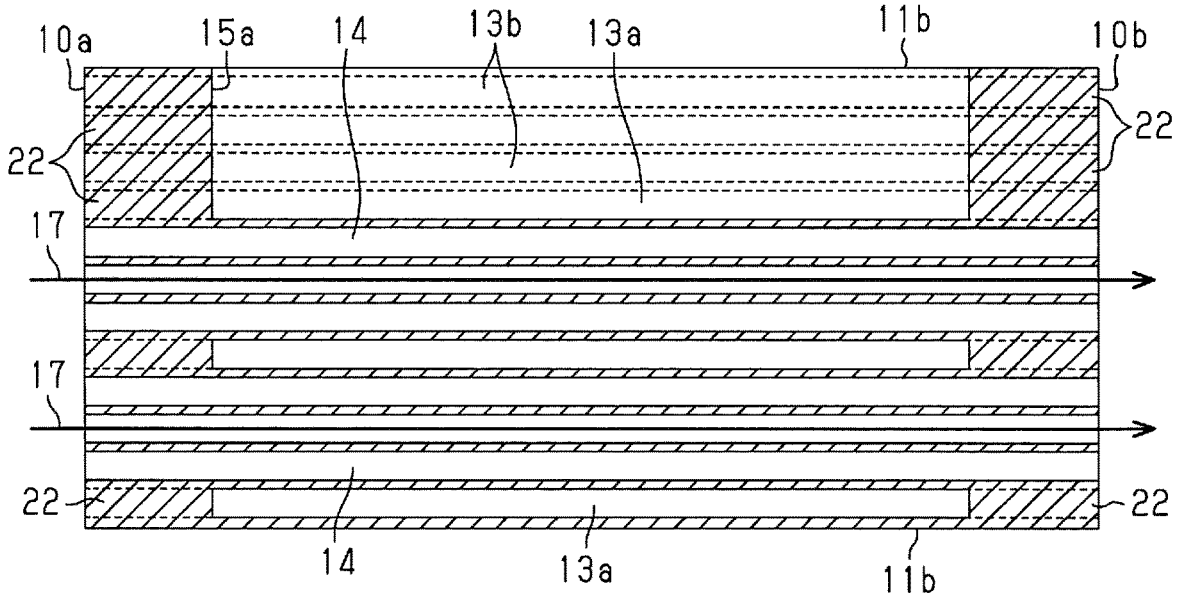
FIG. 4 is a cross-sectional view taken along line 4-4 in FIG. 3.
Figure 5:
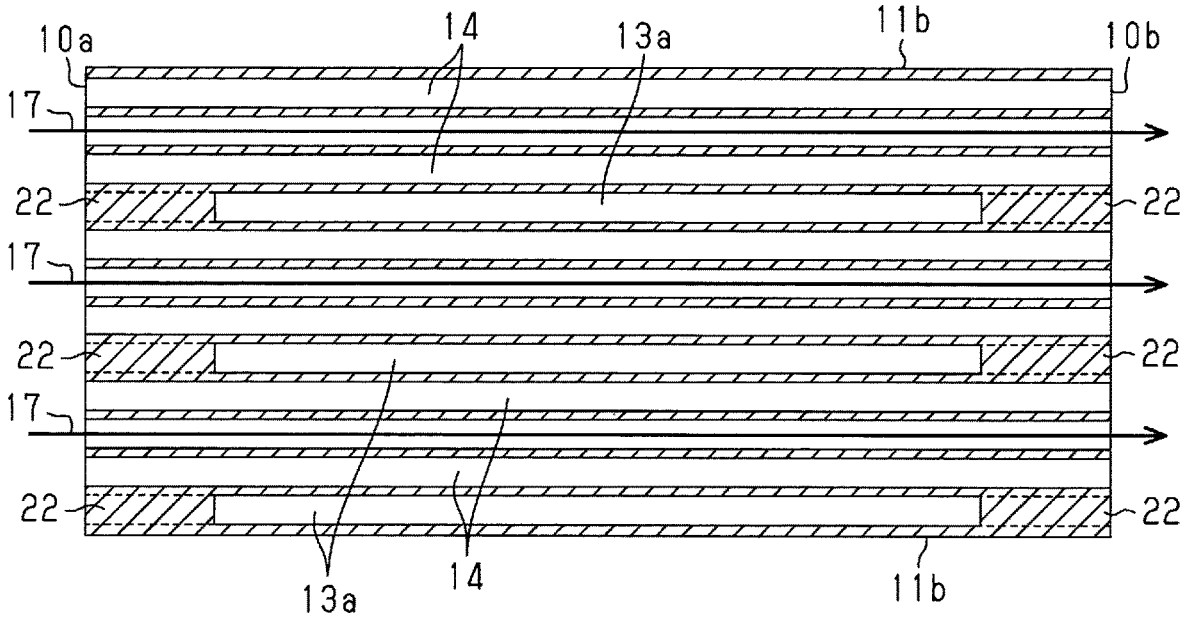
FIG. 5 is a cross-sectional view taken along line 5-5 in FIG. 3.

As shown in FIGS. 3 to 5, the first cells 13 cause the first fluid to flow. The opposite ends of each first cell 13 in the axial direction are each sealed by a sealing portion 22. The second cells 14 cause the second fluid to flow. The opposite ends of each second cell 14 in the axial direction are open.

The first fluid is not particularly limited. For example, a known heat medium may be used. The known heat medium includes, for example, coolant, such as long life coolant ("LLC") and organic solvents such as ethylene glycol. The second fluid is not particularly limited and may include, for example, exhaust gas in an internal combustion engine.

As shown in FIG. 2, the first cells 13 include horizontal cells 13*a* and vertical cells 13*b*. Each horizontal cell 13*a* has a horizontally-long quadrilateral shape in the cross-sectional view and has two long sides parallel to the horizontal walls 11*b*. The horizontal cells 13*a* are located away from one of the horizontal walls 11*b*, namely, a first horizontal wall 11*b*. The other one of the two horizontal walls 11*b* is referred to as a second horizontal wall 11*b*. In the present embodiment, the outer surface of the first horizontal wall 11*b* is referred to as an upper surface, and the outer surface of the second horizontal wall 11*b* is referred to as a lower surface. In the present embodiment, "upper," "lower," "horizontal," and "vertical" are used to describe the structure of the heat exchanger 10 instead of defining the position of the heat exchanger 10 when used.

Each vertical cell 13*b* is quadrilateral (for example, Square) in the cross-sectional view. The vertical cells 13*b* laid out in the vertical direction are arranged between the opposite ends of each horizontal cell 13*a* in the lateral direction and the first horizontal wall 11*b*.

More specifically, the first cells 13 include three horizontal cells 13*a* laid out between two horizontal walls 11*b*. The three horizontal cells 13*a* have different lengths in the lateral direction. The closer to the second horizontal wall 11*b* becomes, the longer in the lateral direction the horizontal cells 13*a* become. The three horizontal cells 13*a* are spaced apart from one another to be parallel to one another.

One horizontal cell 13*a* and a plurality of vertical cells 13*b* laid out between the opposite ends of the horizontal cell 13*a* in the lateral direction and the first horizontal wall 11*b* constitute a first cell row. The first cell row has a U-shaped cross section. The first cells 13 include three first cell rows that are nested.

Further, the second cells 14 are laid out between two adjacent first cell rows along the first cell rows to constitute one or more second cell rows having a U-shaped cross section. The number of the second cell rows arranged between two adjacent first cell rows is not particularly limited. However, for example, when the second fluid is gas such as exhaust gas of an internal combustion engine, the number of the second cell rows may be two or more, or three, or four.

As shown in FIG. 3, each first cell row is provided with two communication portions 15*a* and 15*b* to constitute first passages 16. Each of the communication portions 15*a* and 15*b* extends through the partition walls 12, which are located above and below the vertical cells 13*b* laid out in the vertical direction, so that the vertical cells 13*b* are in communication with one another. In addition, each communication portion 15*a* allows communication between one end of the horizontal cell 13*a* in the lateral direction and the vertical cell 13*b*, and each communication portion 15*b* allows communication between the other end of the horizontal cell 13*a* in the lateral direction and the vertical cell 13*b*. All of the communication portions 15*a* and 15*b* of the three first cell rows open in the same surface of the peripheral wall 11 (outer surface of first horizontal wall 11*b*). The length of each opening in the axial direction is equal to the length of each of the communication portions 15*a* and 15*b* having the opening in the axial direction. The communication portions 15*a* and 15*b* may extend over substantially the entire length of the first cell 13 in the axial direction.

As shown in FIG. 3, the heat exchanger 10 internally includes three first passages 16 having a U-shaped cross section. Each first passage 16 is constituted by a single first cell row, which includes first cells (including horizontal cell 13*a* and vertical cell 13*b*), and the communication portions 15*a* and 15*b* provided in the first cell row. Each first passage 16 includes two openings, i.e., inflow port and outflow port, in the same surface of the peripheral wall 11. In other words, a single first passage 16 has a U-shaped cross section and is constituted by combining apart where the first fluid flows in the vertical direction with a part where the first fluid flows in the lateral direction. The part where the first fluid flows in the vertical direction is constituted by the communication portions 15*a* and 15*b* vertically extending through the vertical cells 13*b*. The part where the first fluid flows in the lateral direction is constituted by the horizontal cells 13*a*. The three first passages 16 are independent from one another.

Additionally, as shown in FIGS. 4 and 5, the heat exchanger 10 internally includes second passages 17. Each second passage 17 is constituted by a single second cell 14. Each second cell 14 includes opposite ends 10*a* and 10*b* in the axial direction, which each act as an inflow port and an outflow port. The heat exchanger 10, which has the above structure, is capable of exchanging heat through the partition walls 12 between the first fluid, which flows through the first passages 16, and the second fluid, which flows through the second passages 17.

More specifically, as shown in FIG. 3, when the heat exchanger 10 is used, a passage member 18 (shown by long dashed double-short dashed lines in FIG. 3) configured to supply and discharge the first fluid to and from the first passages 16 is provided on the surface of the peripheral wall 11 on which the inflow ports and the outflow ports of all the first passages 16 are arranged (outer surface of first horizontal wall 11*b*). The passage member 18 includes a partition 18*a* located at the outer side of the surface of the peripheral wall 11 on which the inflow ports and the outflow ports of all the first passages 16 are arranged. The partition 18*a* separates an inflow space S1 and an outflow space S2 from each other. The inflow space S1 is in communication with the inflow ports of all the first passage 16, and the outflow space S2 is in communication with the outflow ports of all the first passage 16. An inlet passage 18*b* and a discharge passage 18*c* are connected to the partition 18*a*. The inlet passage 18*b* and discharge passage 18*c* are in communication with the inflow space S1 and outflow space S2, respectively. The first fluid is supplied to the inflow space S1 through the inlet passage 18*b*. The first fluid is discharged from the outflow space S2 through the discharge passage 18*c*.

When the first fluid is supplied to the inflow space S1 through the inlet passage 18*b* of the passage member 18, the first fluid flows from the three inflow ports into the first passages 16. Then, the first fluid passes through the first passages 16, which have a U-shaped cross section, flows out from the three outflow ports to the outflow space S2, and is discharged through the discharge passage 18*c*. The flow direction of the first fluid flowing through the three first passages 16 is the same.

In this manner, in the heat exchanger 10, the first fluid flows in the first passage 16 in a direction substantially perpendicular to the axial direction, and the second fluid flows in the second passage 17 in the axial direction. Heat is exchanged through the partition walls 12 between the first fluid and the second fluid, which flow in directions intersecting each other in the heat exchanger 10. That is, the flow direction of the first fluid and the flow direction of the second fluid are not parallel to each other, and the first passages 16 and the second passages 17 are located at skew positions.

The materials for constituting the peripheral wall 11 and partition wall 12 of the heat exchanger 10 are not particularly limited. Instead, materials used for known heat exchangers may be used. For example, such materials include carbide such as silicon carbide, tantalum carbide, and tungsten carbide and nitride such as silicon nitride and boron nitride. Among these materials, one containing silicon carbide as a main component has a higher thermal conductivity than other ceramic materials. Such a material increases the efficiency of heat exchange. The "main component" refers to a component of 50 mass percent. The material containing silicon carbide as a main component is, for example, a material containing particles of silicon carbide and silicon metal.

One method for manufacturing the heat exchanger of the present embodiment will now be described with reference to FIGS. 6A to 13. The heat exchanger is manufactured by sequentially undergoing a shaping step, a machining step, a degreasing step, and an impregnation step, which will be described below.

Shaping Step

Figure 6A:
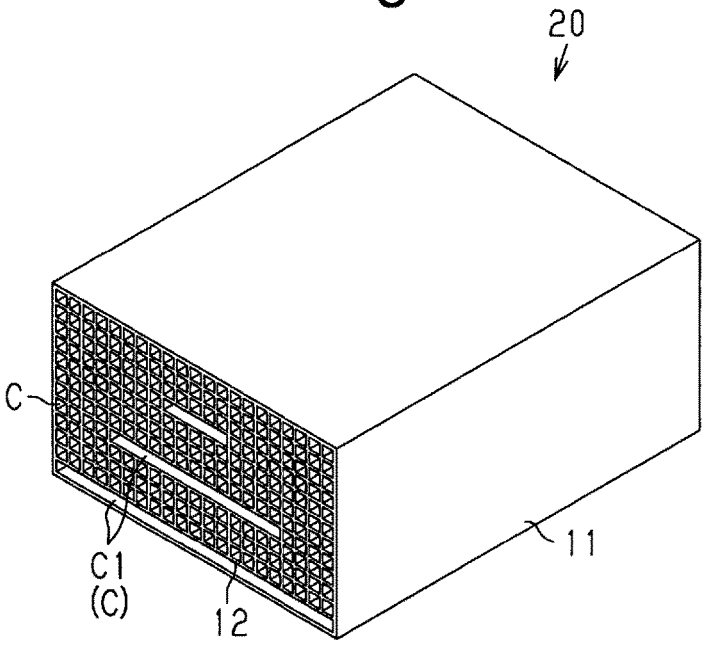
FIG. 6A is a perspective view showing a shaped body shaped in a shaping step.
Figure 6B:
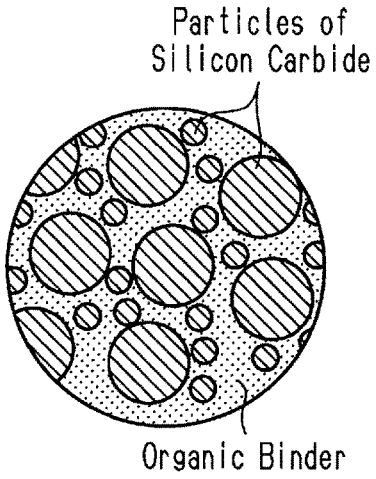
FIG. 6B is a diagram illustrating a material of the shaped body of FIG. 6A.
Figure 7:
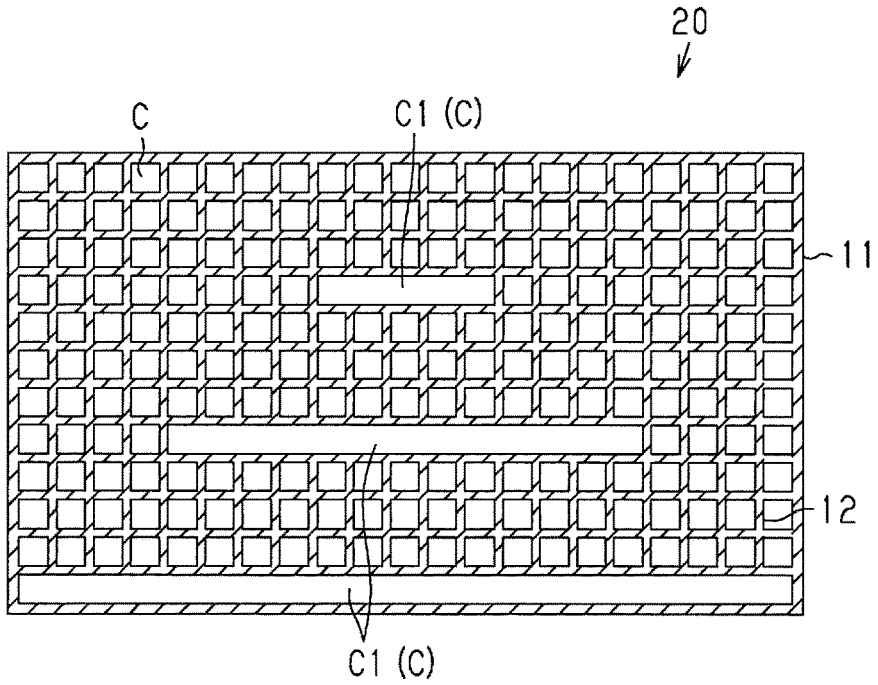
FIG. 7 is a cross-sectional view showing the shaped body of FIG. 6A.

A clayey mixture (refer to FIG. 6B) containing, for example, particles of silicon carbide, organic binders, and dispersion media, is prepared as a material used for shaping the heat exchanger. This clayey mixture is used to shape a shaped body 20, which is shown in FIGS. 6A and 7. The shaped body 20 includes the peripheral wall 11, which has a rectangular tube shape, and the partition walls 12, which divide the inside of the peripheral wall 11 into a plurality of cells C extending in the axial direction of the peripheral wall 11. The partition walls 12 are shaped integrally with the peripheral wall 11. The opposite ends of all the cells C included in the shaped body 20 in the axial direction are open. In addition, the cells C include one or more (for example, three, as shown in the present embodiment) cells C1, which serve as the horizontal cells 13*a*, and other multiple normal cells C. Each normal cell C has a quadrilateral (for example, square) cross section. Each cell C1 has a horizontal length extending over the multiple normal cells C, which are laid out horizontally. That is, each cell C1 has a horizontally-long cross section. The shaped body 20 is shaped through, for example, extrusion. A drying step for drying the shaped body 20 is performed for the obtained shaped body 20.

Machining Step

The machining step includes first machining for forming the communication portions in the shaped body and second machining for sealing the opposite ends of some of the cells in the shaped body.

Figure 8:
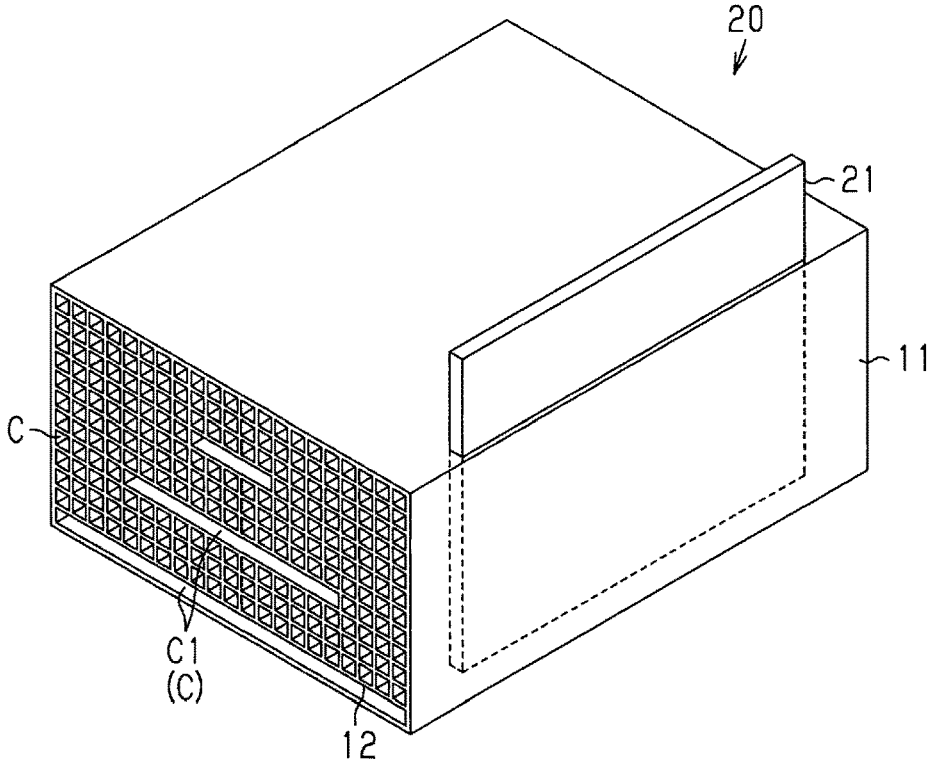
FIG. 8 is a diagram illustrating a machining step, in which a machining tool for first machining is inserted into the shaped body.

As shown in FIG. 8, in the first machining, for example, a method for causing a heated machining tool 21 to be in contact with the shaped body 20 is used to partially remove the peripheral wall 11 and the partition walls 12 in the shaped body 20 and form the communication portions 15*a* and 15*b*.

Figure 9:
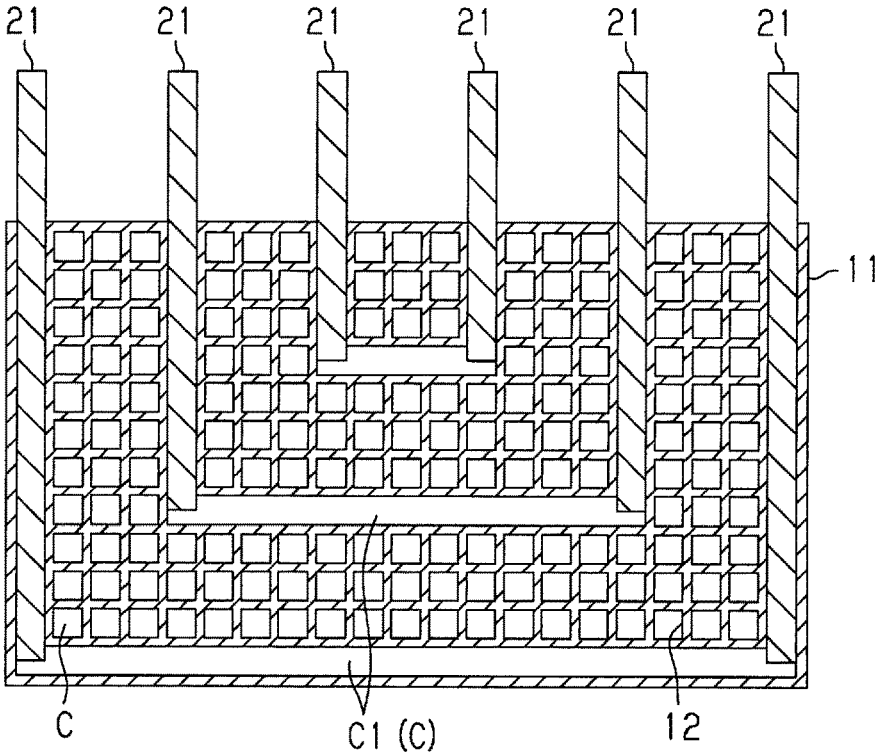
FIG. 9 is across-sectional view showing the shaped body in the machining step.

More specifically, as shown in FIGS. 8 and 9, one or more plate-shaped machining tools 21 having the outer shapes corresponding to the communication portions 15*a* and 15*b* are prepared. When the number of the machining tools 21 is set to be equal to the number of the communication portions 15*a* and 15*b*, all the communication portions 15*a* and 15*b* can be simultaneously formed through one-time first machining. The machining tool 21 is made of heat-resistant metal (for example, stainless steel). The thickness of the machining tool 21 is set to a thickness that does not exceed the width of each normal cell (length in the lateral direction). Next, the machining tool 21 is heated to a temperature at which the organic binders contained in the shaped body 20 are burned off. For example, when the organic binder is methyl cellulose, the machining tool 21 is heated to 400° C. or higher.

As shown in FIG. 9, one or more heated machining tools 21 are arranged in parallel to the vertical walls 11*a* and inserted from the outer surface (upper surface) of the shaped body 20 toward the opposite ends of each cell C1 in the lateral direction. After the machining tools 21 are inserted to reach the position of each cell C1, the machining tool 21 is removed. When the heated machining tools 21 contact the shaped body 20, the organic binders contained in the shaped body 20 are burned off at the contact portion. Thus, the insertion resistance of the machining tools 21 into the shaped body 20 is extremely small. This limits deformation and breakage that occur around the inserted portion when the machining tools 21 are inserted. Further, when the organic binders are burned off, the amount of machining waste produced decreases. Removal of the inserted machining tools 21 forms the communication portions 15*a* and 15*b*.

Figure 10:
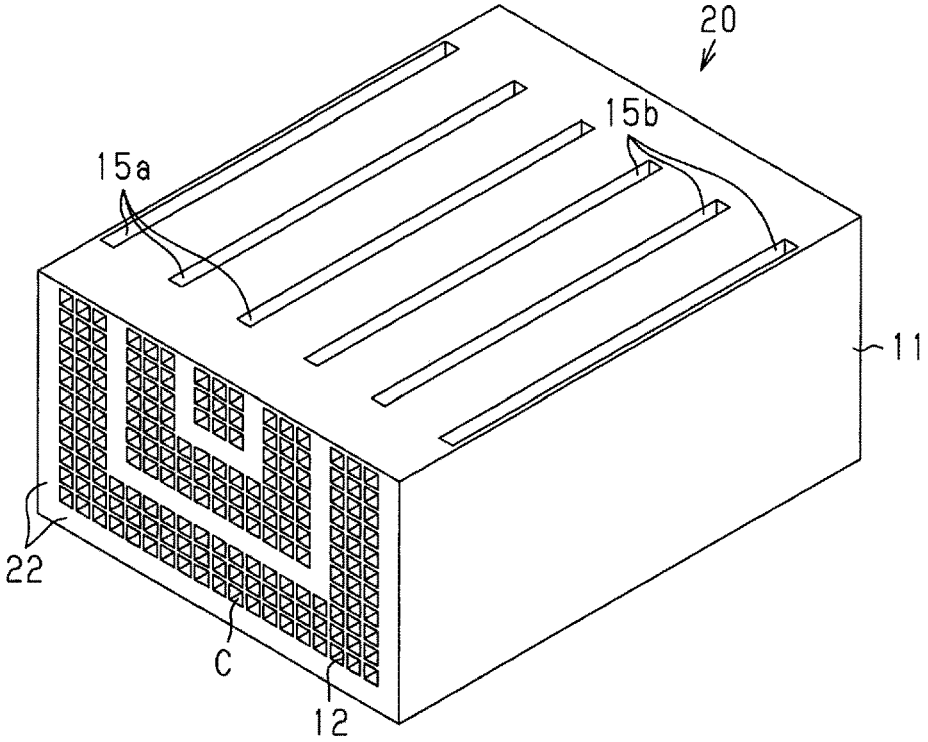
FIG. 10 is a diagram illustrating second machining of the machining step.

As shown in FIG. 10, in the second machining, among the cells C formed in the shaped body 20, the opposite ends of all the cells C in the axial direction constituting the first cells 13 are filled with the clayey mixtures used in the shaping step. This forms, including the cells C1 having a horizontally-long cross section, the sealing portions 22, which seal the opposite ends of the cells C constituting the first cell 13. Subsequently, the drying process for drying the sealing portions 22 is performed for the shaped body 20.

The machined shaped body is obtained through the machining step including the first machining and the second machining. The order of the first machining and the second machining is not particularly limited. The first machining may be performed after the second machining.

Degreasing Step

Figure 11A:
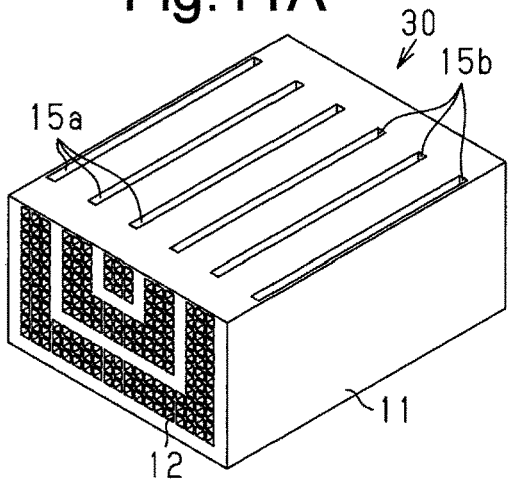
FIG. 11A is a perspective view showing a degreased body obtained through a degreasing step.
Figure 11B:
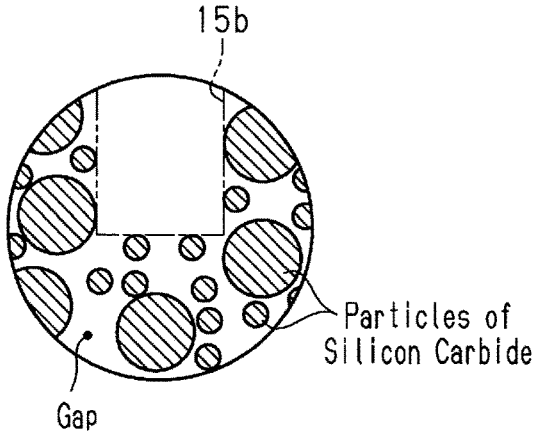
FIG. 11B is a diagram illustrating the degreased body of FIG. 11A.

In the degreasing step, the machining shaped body is heated to burn off the organic binders contained in the machining shaped body. By performing the degreasing step, a degreased body 30 (refer to FIG. 11A) in which the organic binders are removed from the machining shaped body is obtained. As shown in FIG. 11B, the degreased body 30, in which the organic binders are removed from the machining shaped body, includes a framework arranged with particles of silicon carbide in contact with one another.

Impregnation Step

In the impregnation step, a wall portion constituting the degreased body is impregnated with silicon metal. In the impregnation step, heating is performed to the melting point of silicon metal (for example, 1450° C.) or higher with the degreased body in contact with a lump of silicon metal. Thus, as shown in FIG. 12B, capillary action causes the molten silicon metal to enter the gaps between the particles constituting the framework of the degreased body so that the gaps are impregnated with the silicon metal.

A heating process of the impregnation step may be performed consecutively from a heating process of the degreasing step. For example, the degreased body may be formed by removing the organic binders through heating at a temperature lower than the melting point of silicon metal with a lump of silicon metal in contact with the machining shaped body. Subsequently, the heating temperature may be increased to the melting point of silicon metal or higher for the degreased body to be impregnated with the molten silicon metal.

Figure 12A:
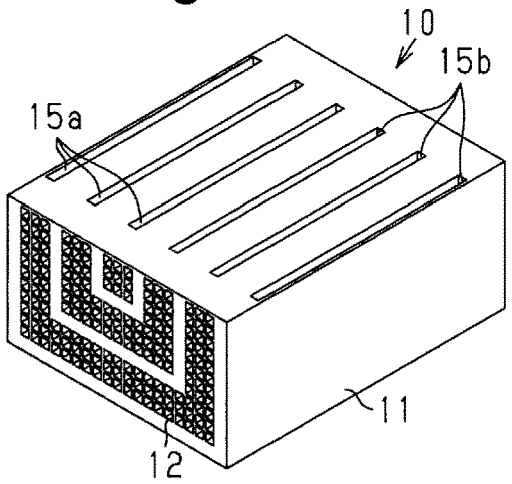
FIG. 12A is a perspective view showing the degreased body that has undergone an impregnation step.
Figure 12B:
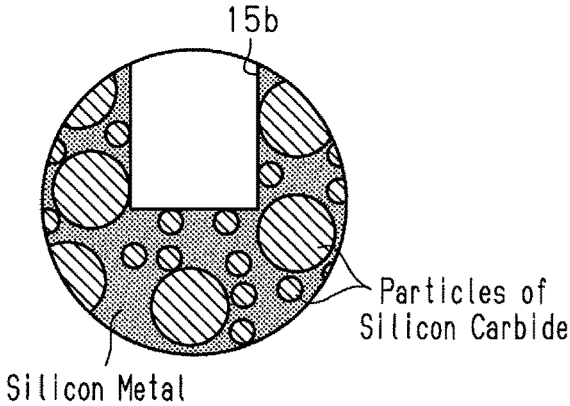
FIG. 12B is a diagram illustrating the degreased body of FIG. 12A.

The heat exchanger 10 shown in FIG. 12A is obtained through the impregnation step.

In the present embodiment, a special temperature management may be performed in the steps subsequent to the degreasing step. That is, the steps subsequent to the degreasing step may be performed under the temperature lower than a sintering temperature of silicon carbide contained in the mixture used in the shaping step so that the machining shaped body and the degreased body are not exposed to the sintering temperature or higher. Thus, in the degreasing step, heating may be performed at a temperature at which the organic binders can be burned off or higher and at a temperature lower than the sintering temperature. In the same manner, in the impregnation step, heating may be performed at the melting point of silicon metal or higher and the temperature lower than the sintering temperature.

Some advantages of the present embodiment will now be described.

(1) A heat exchanger includes a peripheral wall having a polygonal tube shape and a plurality of partition walls that divide an inside of the peripheral wall into a plurality of first cells and a plurality of second cells extending in an axial direction of the peripheral wall. Ends of each of the first cells in the axial direction are sealed and adjacent ones of the first cells are in communication with one another so that the first cells constitute a first passage having a U-shaped cross section perpendicular to the axial direction. The first passage includes an inflow port and an outlet port that are open in the same surface of the peripheral wall. Each of the second cells constitutes a second passage including an inflow port and an outflow port provided respectively at ends of the second cell in the axial direction. Heat is exchanged between a first fluid flowing through the first passages and a second fluid flowing through the second passages.

In the above structure, all the inflow ports and all the outflow ports included in one or more first passages open in the same flat outer surface of the peripheral wall. Thus, the passage member configured to supply and discharge the first fluid can be attached to the same surface of the peripheral wall. This reduces the installment space for the heat exchanger including the passage member.

In addition, the first passage is U-shaped in the cross section perpendicular to the axial direction. This allows the temperature of the first fluid to be easily reflected on the entire heat exchanger. For example, when the first fluid is coolant, the entire heat exchanger can be cooled efficiently. This increases the heat exchange efficiency of the heat exchanger.

(2) The first passages are nested in the cross section perpendicular to the axial direction. The second passages are arranged between adjacent two of the first passages.

The above structure increases the effect of easily reflecting the temperature of the first fluid on the entire heat exchanger.

(3) The flow direction of the first fluid is the same in the adjacent two of the first passages.

The above structure allows the inflow ports of the two adjacent first passages to be close to each other on the same flat outer surface of the peripheral wall. The same applies to the outflow ports of the two adjacent first passages. Thus, the first fluid is easily supplied and discharged to and from the first passages using a common passage member.

(4) The second, fluid is gas such as exhaust gas of an internal combustion engine. The number of rows in which a plurality of second cells is laid out between adjacent two of the first passages is two or more.

The above structure increases the proportion of the second cells occupying the cross section of the heat exchanger and therefore increases the total cross-sectional area of the second passages. This decreases the velocity of the second fluid passing through the second passages and lengthens the time for the second fluid and the partition walls to contact each other. In addition, the area of the second passages in contact with the second fluid increases. This allows heat of the second fluid to be easily transferred to the partition walls and increases the heat exchange efficiency of the heat exchanger.

(5) The partition walls may include silicon carbide as a main component. Among ceramic materials, silicon carbide has a high thermal conductivity and therefore increases the thermal conductivity of the partition walls. This may increase the heat exchange efficiency of the heat exchanger.

(6) The heat exchanger of the present embodiment may be manufactured under the above-described temperature control so that particles of silicon carbide may be arranged in contact with one another. This may form the framework and fill the gaps of the framework with silicon metal, and therefore keeps the shape. That is, the particles of the silicon carbide may not have a bound part (neck) that is formed through sintering. Thus, even if the internal temperature difference in the partition wall results in distortion of the partition wall during use of the heat exchanger, cracks in the neck between the particles of the silicon carbide may be limited. Additionally, extension of cracks caused by the neck may be limited.

It should be apparent to those skilled in the art that the present disclosure may be embodied in Many other specific forms without departing from the spirit or scope of the present disclosure. Particularly, it should be understood that the present disclosure may be embodied in the following forms.

Figure 13:
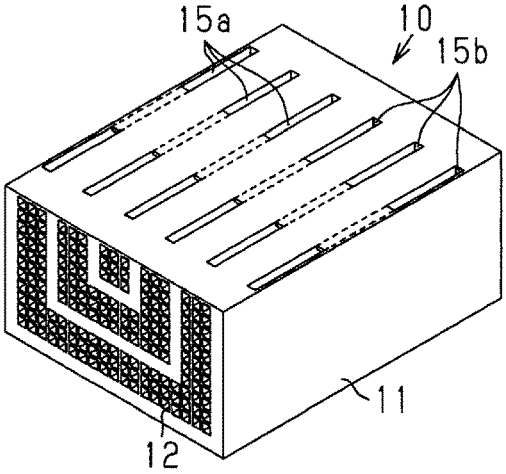
FIG. 13 is a perspective view showing a heat exchanger of a first modification.

As illustrated in a first modification of FIG. 13, the inflow port of a single first passage may be divided into a plurality of segments. Further, the outflow port of a single first passage may be divided into a plurality of segments. That is, the opening of each of the communication portions 15*a* and 15*b* that is open in the peripheral wall 11 of may be divided into a plurality of segments. Further, only one of the inflow port and the outflow port may be divided into a plurality of segments.

When all the inflow ports and all the outflow ports are open in the same flat outer surface (opening surface) of the peripheral wall, the opening surface tends to have a low strength. Thus, the division of the inflow ports and the outflow ports into a plurality of segments may limit decreases in the strength of the peripheral wall.

The number of the first passages is not limited to three and may be, for example, one, two, or four or more.

Figure 14:
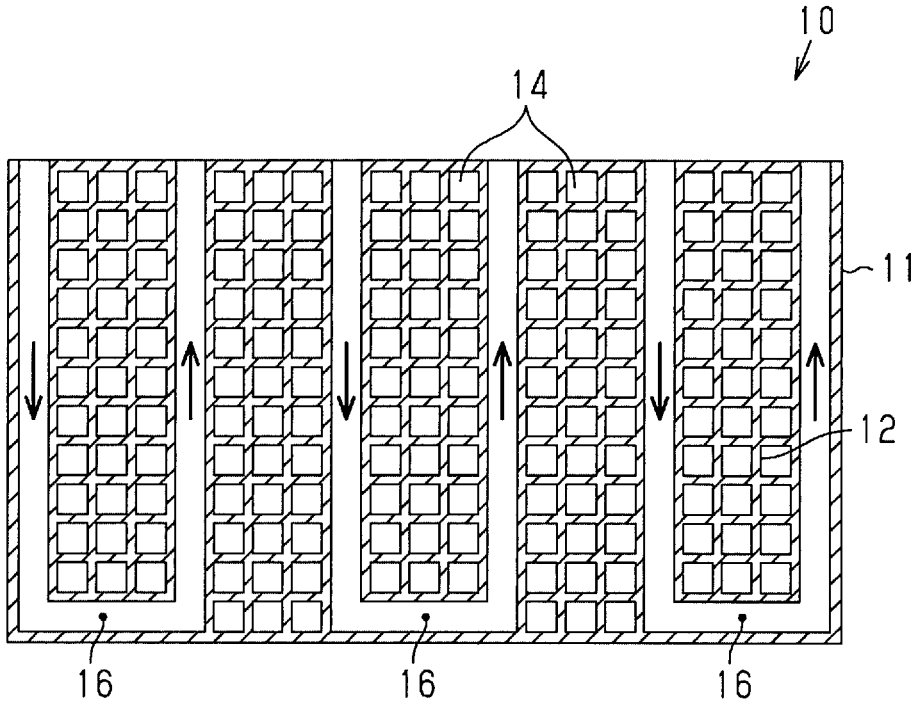
FIG. 14 is a cross-sectional view showing a heat exchanger of a second modification.

In the above-described embodiment, the first passages are nested. However, the first passages do not have to be arranged in this manner. For example, as illustrated in a second modification of FIG. 14, the first passage 16 may be arranged parallel to one another.

The first passages may have different flow rates of the first fluid flowing therethrough (flow rate per unit of time). That is, at least two first passages may have different flow rates of the first fluid flowing therethrough. Adjustment of the flow rates of the first fluid depending on the position or shape of the first passage may increase the heat exchange efficiency of the heat exchanger.

For example, when the first passages are nested, the first passage on the outer side has a longer passage length than the first passage on the inner side. Thus, as the outflow port becomes closer, the heat exchange efficiency of the first passage on the inner side may become lower. When the flow amount of the first fluid flowing in the first passage having a long passage length is set to be larger than the flow amount of the first fluid flowing in the first passage having a short passage length, decreases in the heat exchange efficiency of the first passage having a long passage length may be limited. Methods for adjusting the flow rate of the first fluid may include, for example, a method for differentiating the cross section of the first passage and a method for providing the first passage or the passage member with a constriction or a flow rate control valve having a different opening degree.

When the heat exchanger includes a plurality of first passages, the flow direction of the first fluid may be different among the first passages. That is, the flow direction of the first fluid may be different in at least two first passages.

Figure 15:
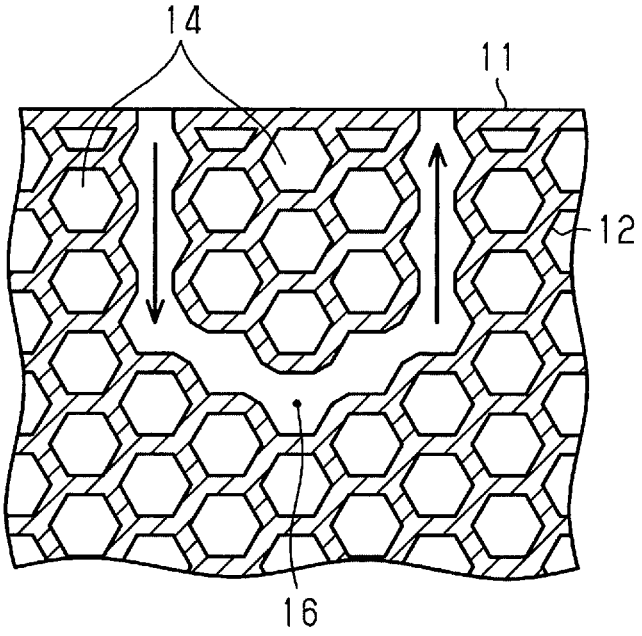
FIG. 15 is a partial, cross-sectional view showing a heat exchanger of a third modification.
Figure 16A:
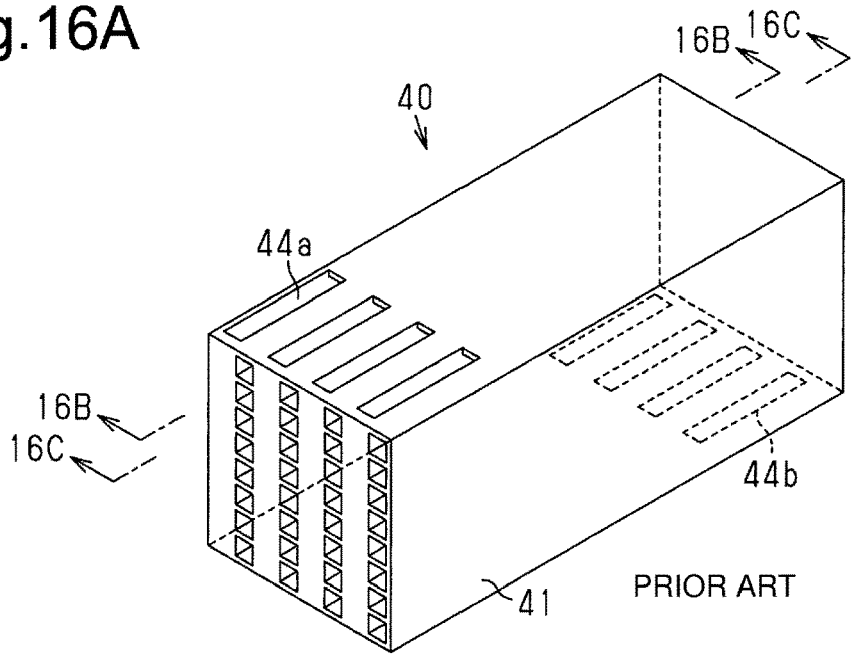
FIG. 16A is a perspective view showing a conventional heat exchanger.
Figure 16B:
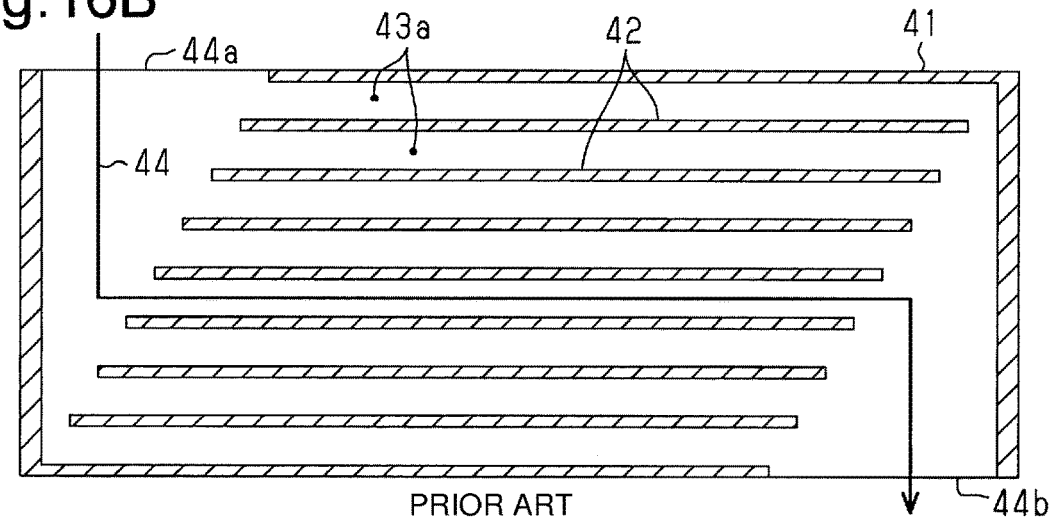
FIG. 16B is a cross-sectional view taken along line 16B-16B in FIG. 16A.
Figure 16C:
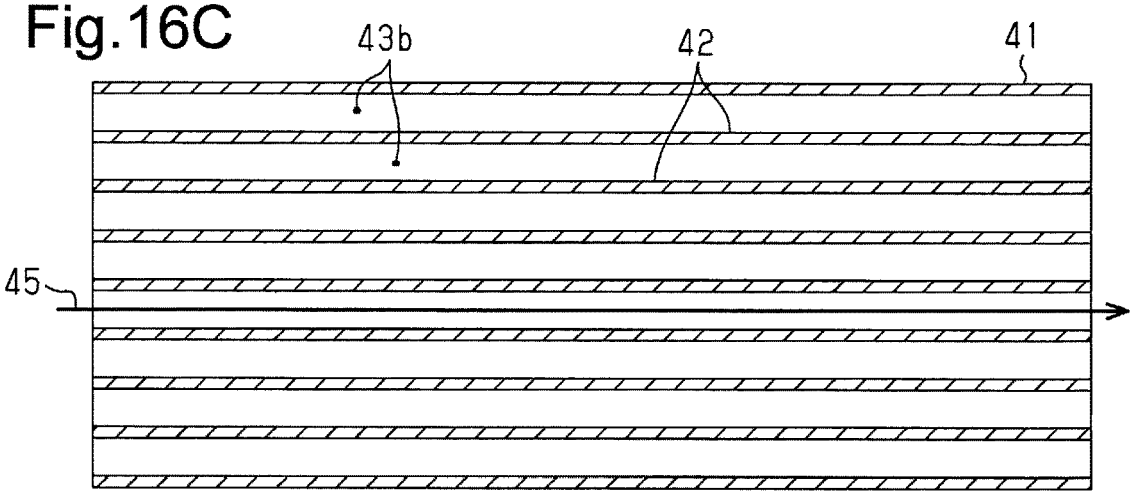
PRIOR ART Fig.16C
FIG. 16C is a cross-sectional view taken along line 16C-16C in FIG. 16A.

The cross-sectional shape of the second cell constituting the second passage is not limited to be quadrilateral. For example, as illustrated in a third modification of FIG. 15, the cross section of the second cell 14 may be hexagonal. In this case, the cross section perpendicular to the axial direction of the first passage 16 may be U-shaped. In addition, the inflow ports and outflow ports of the first passage 16 may open in the same flat outer surface of the peripheral wall.

The number of the second cell rows arranged between adjacent two of the first passages may be the same or different. For example, when three first passages, namely, a first passage 16A, a second passage 16B, and a third passage 16C are laid out in this order, the number of the second cell rows arranged between the first passage 16A and the first passage 16B may be the same as or different from the number of the second cell rows arranged between the first passage 16B and the first passage 16C.

The cross-sectional shape of the peripheral wall is not limited to be rectangular and may be any polygon. For example, the cross-sectional shape of the peripheral wall may be triangular, pentagonal, or hexagonal. That is, the peripheral wall may have three or five or more flat outer surfaces.

The structure of the passage member is not particularly limited. The passage member simply needs to be capable of supplying and discharging the first fluid to and from one or more first passages. For example, the passage member may separately include a portion to which the first fluid is supplied and a portion from which the first fluid is discharged. In addition, when the heat exchanger includes a plurality of first passages, one of the first passages may include a portion to which the first fluid is supplied, and another one of the first passages may include a portion from which the first fluid is discharged, respectively.

The heat exchanger may include the passage member as its constituting element. In this case, the passage member may be provided separately from the main body including the peripheral wall and the partition or may be provided integrally with the peripheral wall of the main body.

In the above-described embodiment, the peripheral wall and the partition wall may be made of a material containing silicon carbide as a main component. However, the peripheral wall and the partition wall do not have to be made of such a material. For example, only the partition wall may be made of a material containing silicon carbide as a main component. Alternatively, the peripheral wall and the partition wall may be made of a material other than the material containing silicon carbide as a main component. In addition, the passage member serving as a constituting element of the heat exchanger may be made of the same material as the peripheral wall and the partition wall or made of different materials.

While this disclosure includes specific examples, it will be apparent to one of ordinary skill in the art that various changes in form and details may be made in these examples without departing, from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A heat exchanger, comprising:

a peripheral wall having a polygonal tube shape; and partition walls that divide an inside of the peripheral wall into first cells and second cells, the first cells and the second cells extending in an axial direction of the peripheral wall, wherein ends of each of the first cells in the axial direction are sealed and adjacent ones of the first cells are in communication with one another so that the first cells constitute a first passage having a U-shaped cross section perpendicular to the axial direction, the first passage comprising an inflow port and an outflow port that are open in the same surface of the peripheral wall, each of the second cells constitutes a corresponding second passage, the second passages each comprising an inflow port and an outflow port provided respectively at ends of each of the second cells in the axial direction, and heat is exchanged between a first fluid flowing through the first passage and a second fluid flowing through the second passages.

2. The heat exchanger according to claim 1, wherein at least two of the first passages are nested in the cross section perpendicular to the axial direction, and at least two of the second passages are arranged between adjacent two of the nested first passages.

3. The heat exchanger according to claim 2, wherein a flow direction of the first fluid is the same in the adjacent two of the nested first passages.

4. The heat exchanger according to claim 2, wherein at least two of the first passages have different flow rates of the first fluid flowing therethrough.

5. The heat exchanger according to claim 1, wherein at least one of the inflow port and the outflow port is divided into segments in each of the first passages.

6. The heat exchanger according to claim 1, comprising a passage member configured to supply and discharge the first fluid to and from the first passage.

7. The heat exchanger according to claim 1, wherein the first passage comprises parallel first passages arranged in a parallel manner in the cross section perpendicular to the axial direction, and at least two of the second passages are arranged between adjacent two of the parallel first passages.

8. The heat exchanger according to claim 1, wherein the peripheral wall has a cross-sectional polygonal shape of a quadrilateral.

9. The heat exchanger according to claim 1, wherein each of the second cells has a cross-sectional polygonal shape of a hexagon.

* * * * *